US006568338B2

(12) United States Patent
Kobayashi

(10) Patent No.: US 6,568,338 B2
(45) Date of Patent: May 27, 2003

(54) SEWING MACHINE HAVING BALANCE

(75) Inventor: Hajime Kobayashi, Moriguchi (JP)

(73) Assignee: Jaguar International Corporation, Moriguchi (JP)

( * ) Notice: Subject to any disclaimer, the term of this patent is extended or adjusted under 35 U.S.C. 154(b) by 0 days.

(21) Appl. No.: 09/988,205

(22) Filed: Nov. 19, 2001

(65) Prior Publication Data

US 2002/0100402 A1 Aug. 1, 2002

(30) Foreign Application Priority Data

Feb. 1, 2001 (JP) ..... 2001-025255

(51) Int. Cl.[7] ..... D05B 69/36
(52) U.S. Cl. ..... 112/273
(58) Field of Search ..... 112/273, 278, 112/275, 241, 57, 96

(56) References Cited

U.S. PATENT DOCUMENTS 3,843,883 A * 10/1974 DeVita et al. ..... 112/273 X
4,192,243 A * 3/1980 Blessing et al. ..... 112/273
4,817,545 A * 4/1989 Mikuni et al. ..... 112/241
5,295,451 A * 3/1994 Takenoya ..... 112/273 X

FOREIGN PATENT DOCUMENTS

JP 2-111392 4/1990

* cited by examiner

*Primary Examiner*—Peter Nerbun
(74) *Attorney, Agent, or Firm*—Armstrong, Westerman & Hattori, LLP

(57) ABSTRACT

A sewing machine capable of preventing formation of no first stitch (skipping stitch), which is readily caused immediately after the sewing machine starts to operate, is obtained. In this sewing machine, a motor is so stopped as to locate a thread engaging part of a balance in the vicinity of a forward movement starting point leftward beyond a thread receiving opening of a thread guide plate. Thus, the thread engaging part of the balance reliably captures and pulls a needle thread immediately after the sewing machine starts to operate. Consequently, formation of no first stitch (skipping stitch), which is readily caused immediately after the sewing machine starts to operate, is prevented.

11 Claims, 4 Drawing Sheets

SEWING MACHINE HAVING BALANCE

BACKGROUND OF THE INVENTION

1. Field of the Invention

The present invention relates to a sewing machine, and more particularly, it relates to a sewing machine having a balance.

2. Description of the Prior Art

A sewing machine having a balance is known in general. This balance has a thread engaging part. The balance is so structured that the thread engaging part captures and pulls a needle thread when forwardly moving from left to right. In this case, the thread engaging part of the balance engages with the needle thread passing through thread receiving openings of a pair of thread guide plates for pulling the same.

When a sewing machine operating switch of the conventional sewing machine having the aforementioned structure is moved to OFF for stopping the sewing machine, however, a motor is generally stopped when a needle is located on a top dead center. When the needle is located on the top dead center, the thread engaging part of the balance is generally located on an intermediate position of the passage for the forward movement beyond the thread guide plates. In other words, the motor is generally stopped regardless of the position of the thread engaging part of the balance.

Therefore, when the sewing machine operating switch is moved to ON after the needle thread is exchanged, for example, the sewing machine starts the first operating cycle without capturing and pulling the needle thread by the thread engaging part of the balance. Thus, the needle thread has no prescribed slack in the first operating cycle of the sewing machine and hence a slack portion formed on a lower portion of cloth for engaging with the forward end of a shuttle body disappears following an operation of a thread take-up spring pulling up the needle thread when the needle passes through the cloth. This may disadvantageously result in formation of no first stitch (the so-called skipping stitch).

When the sewing machine operating switch is moved to ON without exchanging the needle thread, the needle thread may be in a state disengaging from the thread engaging part of the balance due to slacking during the unused state of the sewing machine. In this case, inconvenience similar to the above takes place to disadvantageously result in the so-called skipping stitch.

SUMMARY OF THE INVENTION

An object of the present invention is to provide a sewing machine capable of preventing formation of no first stitch (skipping stitch), which is readily caused immediately after the sewing machine starts to operate.

Another object of the present invention is to readily stop a motor when a needle thread is broken in the aforementioned sewing machine.

A sewing machine according to an aspect of the present invention comprises a thread guide plate having a thread receiving opening, a balance having a thread engaging part and reciprocating through the thread guide plate so that the thread engaging part captures and pulls a needle thread when forwardly moving from left to right and a motor for driving the balance, while the motor is so stopped as to locate the thread engaging part of the balance in the vicinity of a forward movement starting point leftward beyond the thread receiving opening of the thread guide plate.

In the sewing machine according to this aspect, the motor is so stopped as to locate the thread engaging part of the balance in the vicinity of the forward movement starting point leftward beyond the thread receiving opening of the thread guide plate as described above, whereby the thread engaging part of the balance can reliably capture and pull a thread needle also immediately after the sewing machine starts to operate. Therefore, formation of no first stitch (skipping stitch), which is readily caused immediately after the sewing machine starts to operate, can be prevented.

The sewing machine according to the aforementioned aspect preferably further comprises an upper shaft set between the motor and the balance so that the balance reciprocates in association with rotation thereof and an upper shaft rotation detection part detecting rotation of the upper shaft, and the motor is preferably stopped on the basis of a result of detection by the upper shaft rotation detection part. According to this structure, the motor can be readily stopped to locate the thread engaging part of the balance in the vicinity of the forward movement starting point leftward beyond the thread receiving opening of the thread guide plate. In this case, the upper shaft rotation detection part preferably includes a first detected element provided on the upper shaft and a first photoelectric switch detecting the first detected element.

The sewing machine according to the aforementioned aspect preferably further comprises a thread breakage detection part detecting breakage of the needle thread, and the motor is preferably stopped in response to a signal from the thread breakage detection part. According to this structure, the motor can be readily stopped when the needle thread is broken. Thus, the needle thread can be prevented from disadvantageously twining around the thread engaging part of the balance. In this case, the thread breakage detection part preferably includes a rotary part rotating following movement of the needle thread and a rotation detection part detecting rotation of the rotary part. More preferably, the rotary part includes an upper rotator and a lower rotator, the sewing machine further comprises a second detected element provided on a peripheral edge portion of either the upper rotator or the lower rotator, and the rotation detection part includes a second photoelectric switch detecting the second detected element. According to this structure, the rotary part stops rotating when the needle thread is broken, whereby the breakage of the needle thread can be readily detected.

The sewing machine having the aforementioned thread breakage detection part preferably further comprises an upper shaft set between the motor and the balance so that the balance reciprocates in association with rotation thereof and an upper shaft rotation detection part for detecting rotation of the upper shaft, for determining breakage of the needle thread and stopping the motor when the rotation detection part of the thread breakage detection part detects no rotation of the rotary part while the upper shaft rotates by a prescribed number of revolutions. According to this structure, the thread breakage detection part can be prevented from erroneously detecting breakage of the needle thread when the needle thread is not broken. If the needle thread is inferiorly in contact with the rotary part of the thread breakage detection part, the rotary part of the thread breakage detection part may not rotate also when the needle thread is not broken. According to the present invention, such erroneous determination can be effectively prevented by determining breakage of the needle thread when the rotation detection part of the thread breakage detection part detects no rotation of the rotary part while the upper shaft rotates by the prescribed number of revolutions.

In this case, the prescribed number of revolutions is previously set, and the sewing machine preferably further comprises a counter counting up the number of revolutions of the upper shaft and responsively outputting a signal for stopping the motor when the number of revolutions of the upper shaft reaches the prescribed number of revolutions. According to this structure, the motor can be readily stopped in response to the upper shaft reaching the prescribed number of revolutions. In this case, the prescribed number of revolutions is preferably eight.

In the sewing machine including the aforementioned counter, the counter is preferably reset when the rotation detection part of the thread breakage detection part detects rotation of the rotary part. Further, the counter is reset when the motor is stopped.

A sewing machine according to another aspect of the present invention comprises a motor for driving a needle and a thread breakage detection part detecting breakage of a needle thread, while the thread breakage detection part includes a rotary part rotating following movement of the needle thread and a rotation detection part detecting rotation of the rotary part and the motor is stopped in response to a signal from the thread breakage detection part.

The sewing machine according to this aspect is provided with the thread breakage detection part detecting breakage of the needle thread as described above, whereby the motor can be readily stopped when the needle thread is broken. Thus, the needle thread can be prevented from disadvantageously twining around a thread engaging part of a balance when the same is broken.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

Figure 1:
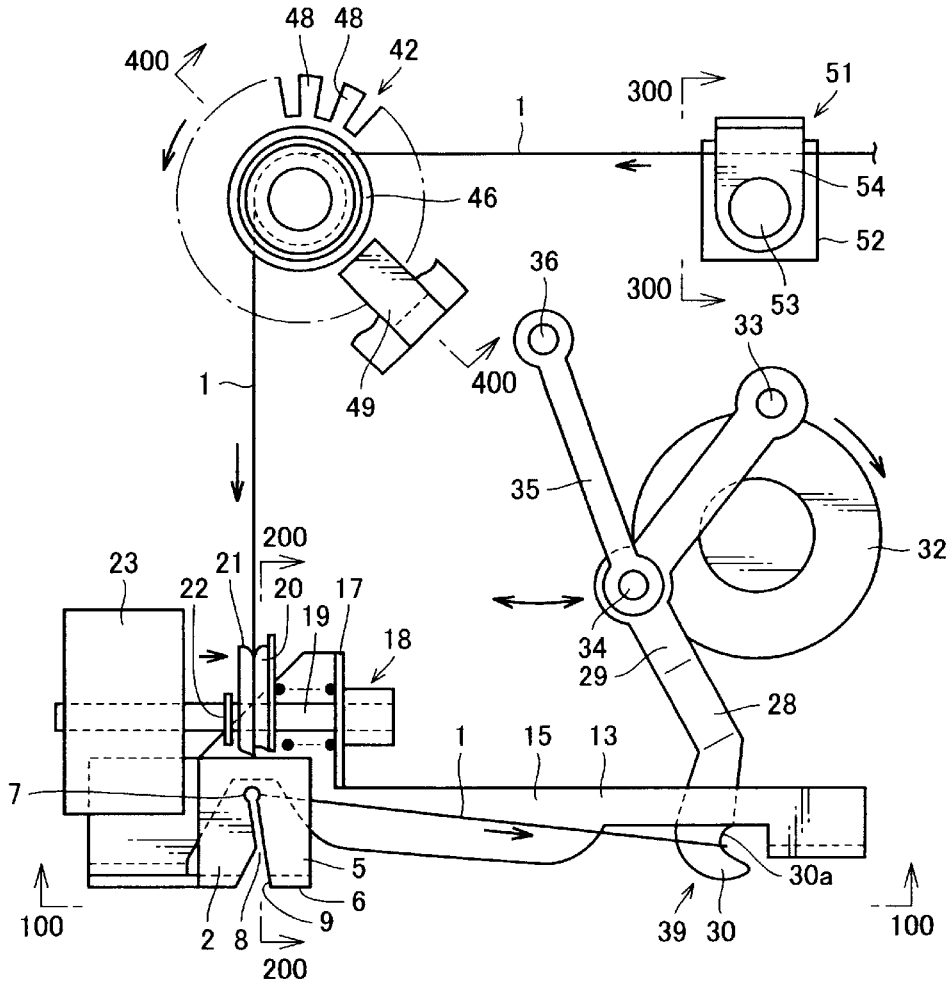
FIG. 1 is a partial plan view of a sewing machine according to an embodiment of the present invention.
Figure 2:
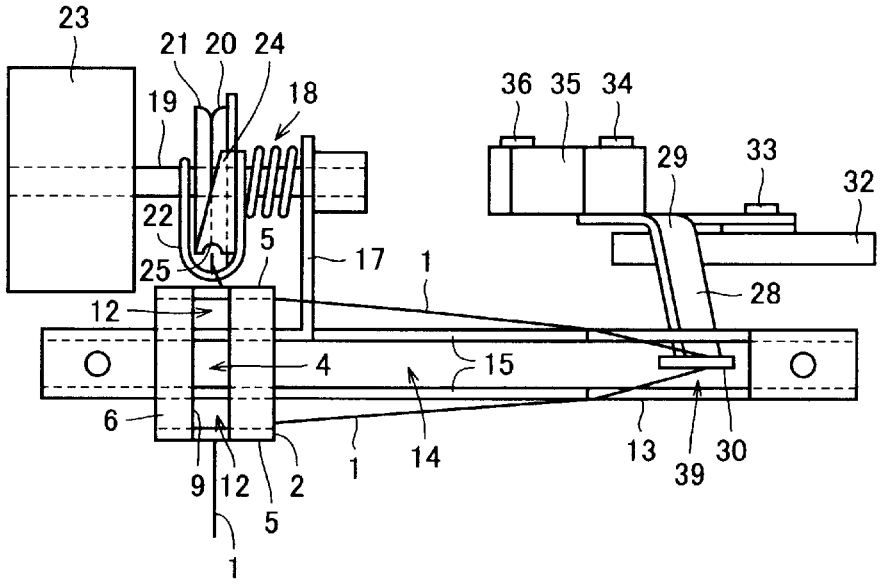
FIG. 2 is a sectional view of the sewing machine according to the embodiment taken along the line 100—100 in FIG. 1.
Figure 3:
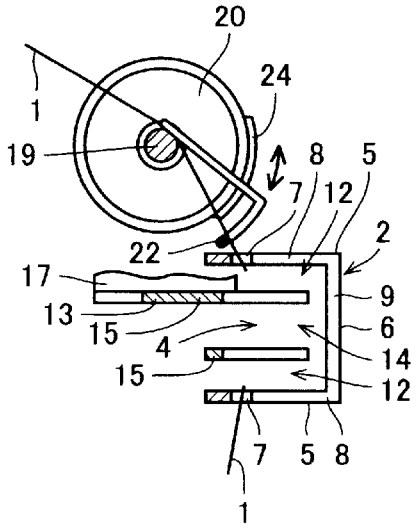
FIG. 3 is a sectional view of the sewing machine according to the embodiment taken along the line 200—200 in FIG. 1.

Referring to a plan view of FIG. 1, the lower side shows a front part of a sewing machine according to the embodiment, and the upper side shows a rear part of the sewing machine. The left side shows a left part of the sewing machine, and the right side shows a right part of the sewing machine.

In the sewing machine according to this embodiment, a needle thread receiving groove (not shown) opening frontward, upward and downward is provided on a left front portion of a sewing machine body arm (not shown). This needle thread receiving groove is formed to overlap with a virtual vertical plane horizontally dividing the sewing machine body arm including a needle (not shown). A thread guide part 2 is mounted on the sewing machine body arm (not shown) to be opposed to the needle thread receiving groove.

The thread guide part 2 includes a pair of thread guide plates 5 and a coupling plate 6. The pair of thread guide plates 5 are opposed to each other through a balance passage clearance 4 allowing passage of a thread engaging part 30 of a balance 28. The coupling plate 6 is provided on front edges of the thread guide plates 5 to couple the pair of thread guide plates 5 with each other. The pair of thread guide plates 5 are provided with thread receiving openings 7 and slits 8 for guiding a needle thread 1 into the thread receiving openings 7 respectively. The coupling plate 6 is formed with a slit 9 communicating with the slits 8.

The sewing machine body arm (not shown) is provided with a balance guide body 13. The balance guide body 13 has a vertical pair of horizontal plates 15 opposed to each other through a balance passage clearance 14 allowing passage of the thread engaging part 30 of the balance 28. The horizontal plates 15 are arranged not to block the thread receiving openings 7 and the slits 8 of the thread guide plates 5. Further, the balance guide body 13 is arranged to define clearances 12 between the same and the upper and lower thread guide plates 5 respectively.

A bracket 17 is provided on a left portion of the upper horizontal plate 15. A thread tension guide 18 is mounted on the bracket 17. The thread tension guide 18 includes a spindle 19, a thread holding element 20, another thread holding element 21, a thread take-up spring 22, urging means (not shown), a dial 23 and a thread guide 24. The spindle 19 is mounted on the bracket 17 to horizontally direct its shaft center. The thread holding element 20 is fixed to the spindle 19. The other thread holding element 21 is engaged with the spindle 19 to be horizontally movable but not rotatable.

The thread take-up spring 22 is mounted on the spindle 19 to be vertically swingable within a prescribed angular range. This thread take-up spring 22 swings upward in an ordinary state receiving no force. The urging means (not shown) is formed to urge the horizontally movable left thread holding element 21 toward the right thread holding element 20. This urging means (not shown) is structured not to inhibit the thread take-up spring 22 from vertical swinging. The dial 23 is provided for controlling the force of the urging means. The thread guide 24, provided on a front edge portion of the right thread holding element 20, has a thread guide groove 25 on its lower portion.

The balance 28 has the thread engaging part 30 horizontally passing through the balance passage clearance 4 defined between the thread guide plates 5. The thread engaging part 30 has an engaging edge 30*a*. An end of a body 29 of the balance 28 is mounted on a peripheral edge portion of a turntable 32 through a shaft 34. An intermediate portion of the body 29 of the balance 28 is mounted on a connecting bar 35 through a shaft 34. The other end of the connecting bar 35 is mounted on the sewing machine arm (not shown) through a shaft 36.

Figure 6:
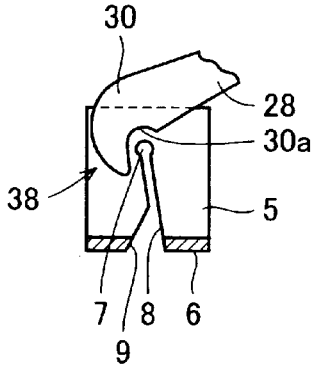
FIG. 6 is a plan view showing a thread engaging part of a balance located on a forward movement starting point in the structure of the sewing machine according to the embodiment shown in FIG. 1.

In the aforementioned structure, the thread engaging part 30 of the balance 28 moves (forward) from a forward movement starting point 38 located on the leftmost side shown in FIG. 6 to a forward movement end point 39 located on the rightmost side shown in FIG. 1. Thereafter the thread engaging part 30 moves (backward) from the forward movement end point 39 to the forward movement starting point 38. In other words, the passage from the forward movement starting point 38 to the forward movement end point 39 is for the forward movement, and the passage from the forward movement end point 39 to the forward movement starting point 38 is for the backward movement.

At the forward movement starting point 38 shown in FIG. 6, the engaging edge 30*a* of the thread engaging part 30 is located leftward beyond the thread receiving openings 7. According to this embodiment, a motor 58 (see FIG. 7) is so stopped as to locate the thread engaging part 30 of the balance 28 in the vicinity of the forward movement starting point 38 leftward beyond the thread receiving openings 7 of the thread guide plates 5. Thus, the motor 58 is stopped on a position not projecting the engaging edge 30*a* provided on the right portion of the thread engaging part 30 into the thread receiving openings 7.

The positional relation between the needle (not shown) and the thread engaging part 30 is now described. When the needle is located on a top dead center, the thread engaging part 30 is located on an intermediate position of the forward movement. When the needle is located on a bottom dead center, the thread engaging part 30 is located on a position slightly closer to the forward movement starting point 38 than an intermediate position of the backward movement.

Figure 5:
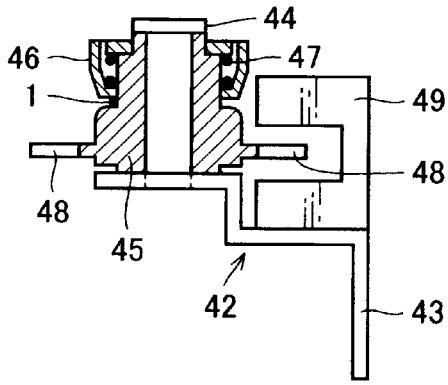
FIG. 5 is a sectional view of the sewing machine according to the embodiment taken along the line 400—400 in FIG. 1.

According to this embodiment, a thread breakage detector 42 is provided on the sewing machine body arm (not shown). This thread breakage detector 42 is located at the back of the thread holding elements 20 and 21 of the thread tension guide 18. As shown in FIG. 5, the thread breakage detector 42 includes a bracket 43, a shaft 44, a lower rotator 45, an upper rotator 46, a spring 47, a plurality of detected elements 48 and a transmission type photoelectric switch 49. The shaft 44 is mounted on the bracket 43. The lower rotator 45 is rotatably provided on the shaft 44. The upper rotator 46 is vertically movably provided on the lower rotator 45 and urged toward the lower rotator 45 by the spring 47. The plurality of detected elements 48 are provided on the peripheral edge portion of the lower rotator 45 to protrude at prescribed angles. The photoelectric switch 49 detects the detected elements 48.

The thread breakage detector 42 is an example of the "thread breakage detection part" according to the present invention, and the detected elements 48 are examples of the "second detected element" according to the present invention. The photoelectric switch 49 is an example of the "second photoelectric switch" according to the present invention.

The needle thread 1 is arranged between the lower rotator 45 and the upper rotator 46. The lower rotator 45 and the upper rotator 46 rotate following movement of the needle thread 1.

Figure 4:
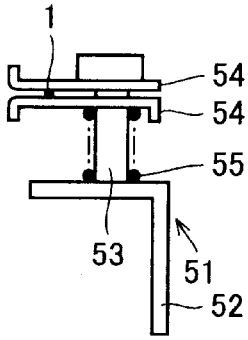
FIG. 4 is a sectional view of the sewing machine according to the embodiment taken along the line 300—300 in FIG. 1.

A thread holder 51 is provided on the sewing machine body arm (not shown) to be located rightward beyond the thread breakage detector 42. As shown in FIG. 4, the thread holder 51 has a bracket 52, a shaft 53, a pair of holding elements 54 and a spring 55. The shaft 53, mounted on the bracket 52, has a stopper on its upper portion. The pair of holding elements 54 are provided on the shaft 53 to be vertically movable but not rotatable. The spring 55 urges the holding elements 54 upward. The needle thread 1 passes through the clearance between the upper and lower holding elements 54.

The way of extending the needle thread 1 delivered from a spool (not shown) to the needle (not shown) is now described. The needle thread 1 delivered from the spool (not shown) passes through the clearances between the holding elements 54 of the thread holder 51, between the lower rotator 45 and the upper rotator 46 of the thread breakage detector 42 and between the thread holding elements 20 and 21 of the thread tension guide 18, the lower side of the thread guide 24, the upper side of the thread take-up spring 22 and the thread receiving openings 7 of the upper and lower thread guides 5, to reach the eye of the needle.

Figure 7:
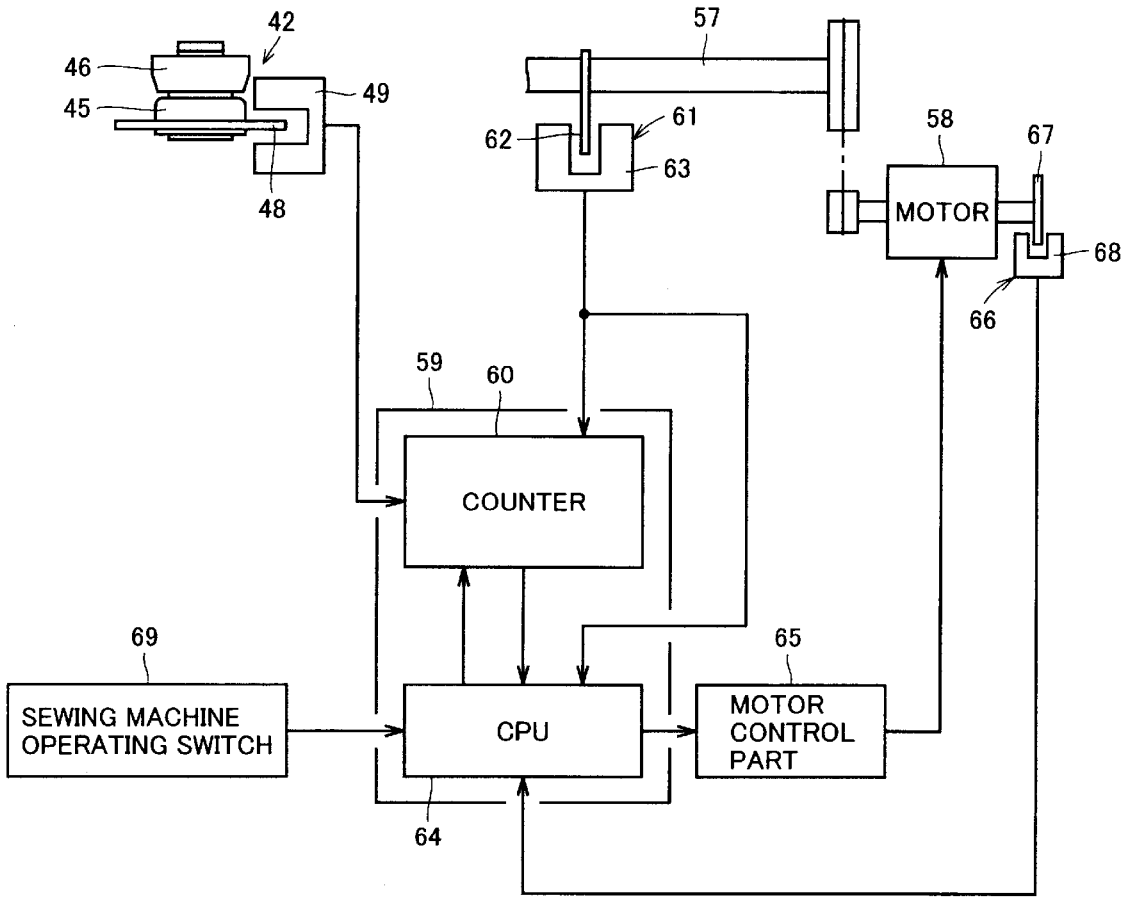
FIG. 7 is a schematic diagram for illustrating a control system for the sewing machine according to the embodiment of the present invention.

A control system for the sewing machine according to this embodiment is now described with reference to FIG. 7. According to this embodiment, the motor 58 rotates an upper shaft 57 of the sewing machine. The upper shaft 57 rotates the turntable 32 (see FIG. 1) while vertically moving the needle (not shown).

The upper shaft 57 is provided with a rotation detector 61 for detecting the number of revolutions and the rotating position of the upper shaft 57. The rotation detector 61 has a detected element 62 mounted on the upper shaft 57 and a transmission type photoelectric switch 63 detecting the detected element 62. The rotation detector 61 is an example of the "upper shaft rotation detection part" according to the present invention, and the detected element 62 is an example of the "first detected element" according to the present invention. The photoelectric switch 63 is an example of the "first photoelectric switch" according to the present invention.

The motor 58 is provided with a speed detector 66 detecting the speed of rotation of the motor 58. The speed detector 66 has a detected disc 67 and a transmission type photoelectric switch 68. The detected disc 67, mounted on the rotary shaft of the motor 58, has a plurality of detected elements on its peripheral edge portion at prescribed intervals. The photoelectric switch 68 detects the detected elements of the detected disc 67.

A computer 59 including a counter 60 and a CPU 64 controls the motor 58. A sewing machine operating switch 69, the photoelectric switch 68 of the speed detector 66 and the photoelectric switch 63 of the rotation detector 61 are connected to the CPU 64. Further, a motor control part 65 controlling an input voltage for the motor 58 is connected to the CPU 64.

Control operations made by the control system for the sewing machine according to this embodiment having the aforementioned structure are now described.

When the sewing machine operating switch 69 is moved to OFF, the CPU 64 receives an OFF signal therefor and transmits a deceleration signal to the motor control part 65. The motor control part 65 receiving the deceleration signal reduces the input voltage for the motor 58. Thus, the motor 58 is decelerated to enter a stoppage setup state. After the motor 58 is decelerated to a speed sufficient for stoppage, the photoelectric switch 63 of the rotation detector 61 for the upper shaft 57 is moved from OFF (for cutting off light) to ON (for passing light), so that the CPU 64 outputs a stop signal to the motor control part 65. Thus, the motor 58 is stopped. The CPU 64 detects sufficient deceleration of the speed of the motor 58 by receiving a speed signal indicating that the motor 58 reaches the speed sufficient for stoppage from the speed detector 66.

When the photoelectric switch 63 of the rotation detector 61 for the upper shaft 57 is moved from OFF to ON, the thread engaging part 30 of the balance 28 is located in the vicinity of the forward movement starting point 38 leftward beyond the thread receiving openings 7 of the thread guide plates 5.

When the photoelectric switch 63 is moved from OFF to ON to stop the motor 58 as described above, the upper shaft 57 is stopped thereby stopping the turntable 32 (FIG. 1). Consequently, the thread engaging part 30 of the balance 28 is stopped in the vicinity of the forward movement starting point 38 leftward beyond the thread receiving openings 7 of the thread guide plates 5, as described above.

The photoelectric switch 49 of the thread breakage detector 42 and the photoelectric switch 63 of the rotation detector 61 for the upper shaft 57 are connected to the counter 60. The photoelectric switch 63 outputs a signal to the counter 60 every time the upper shaft 57 rotates. Thus, the counter 60 counts up by 1 every time the upper shaft 57 rotates. In this case, a set number (numeral "8", for example) is previously input in the counter 60. When the photoelectric switch 49 is moved from OFF (for cutting off light) to ON (for passing light) or from ON to OFF once, the count of the counter 60 is reset.

When the count (number of revolutions of the upper shaft 57) reaches the set number 8, the counter 60 outputs a signal instructing the CPU 64 to stop the motor 58. The CPU 64 receiving the stop signal immediately outputs a deceleration signal to the motor control part 65. The photoelectric switch 63 detecting rotation of the upper shaft 57 is moved from OFF (for cutting off light) to ON (for passing light) similarly to the above, so that the CPU 64 outputs a stop signal to the motor control part 65 for stopping the motor 58. In this case, the thread engaging part 30 of the balance 28 is stopped in the vicinity of the forward movement starting point 38 leftward beyond the thread receiving openings 7 of the thread guide plates 5. Thereafter the CPU 64 acquires information indicating complete stoppage of the motor 58 and outputs a reset signal to the counter 60. Thus, the counter 60 is reset.

As to control of the thread breakage detector 42, the needle thread 1 successively fed toward the needle rotates the lower rotator 45 and hence the photoelectric switch 49 outputs an OFF-ON or ON-OFF signal to the counter 60. Thus, the counter 60 is reset. When the needle thread 1 is broken, the photoelectric switch 49 outputs no OFF-ON or ON-OFF signal to the counter 60, and hence the counter 60 is not reset. In this state, the motor 58 is stopped after the upper shaft 57 rotates eight times.

The motor 58 is stopped after the upper shaft 57 rotates eight times for the following reason: If the needle thread 1 is inferiorly in contact with the lower rotator 45 or the upper rotator 46 of the thread breakage detector 42, the lower rotator 45 of the needle thread detector 42 may not rotate also when the needle thread is not broken. If rotation of the motor 58 is immediately stopped in this case, the thread breakage detector 42 disadvantageously erroneously determines the needle thread 1 as broken although the same is not broken. According to this embodiment, such erroneous determination can be effectively prevented by determining that the needle thread 1 is broken when the photoelectric switch 49 of the thread breakage detector 42 detects no rotation of the lower rotator 45 while the upper shaft 57 rotates eight times.

According to this embodiment, the motor 58 is so stopped as to locate the thread engaging part 30 of the balance 28 in the vicinity of the forward movement starting point 38 leftward beyond the thread receiving openings 7 of the thread guide plates 5 as described above, whereby the thread engaging part 30 of the balance 28 can reliably capture and pull the needle thread 1 also immediately after the sewing machine starts to operate. Consequently, formation of no first stitch (skipping stitch), which is readily caused immediately after the sewing machine starts to operate, can be prevented.

According to this embodiment, the thread breakage detector 42 is provided for detecting breakage of the needle thread 1 while the motor 58 is stopped in response to the signal from the thread breakage detector 42, whereby the motor 58 can be readily stopped when the needle thread 1 is broken. Thus, the needle thread 1 can be prevented from disadvantageously twining around the thread engaging part 30 of the balance 28. Further, the detected elements 48 are provided on the peripheral edge portion of the lower rotator 45 of the thread breakage detector 42 while the photoelectric switch 49 is provided for detecting the detected elements 48, so that the lower rotator 45 stops rotating and the photoelectric switch 49 detects no detected elements 48 when the needle thread 1 is broken. Thus, breakage of the needle thread 1 can be readily detected.

Although the present invention has been described and illustrated in detail, it is clearly understood that the same is by way of illustration and example only and is not to be taken by way of limitation, the spirit and scope of the present invention being limited only by the terms of the appended claims.

For example, while the rotating position of the upper shaft 57 and the operating position of the balance 28 are adjusted for stopping the motor 58 to locate the thread engaging part 30 of the balance 28 in the vicinity of the forward movement starting point 38 leftward beyond the thread receiving openings 7 of the thread guide plates 5 in the aforementioned embodiment, the present invention is not restricted to this but another method may alternatively be employed for stopping the motor 58 to locate the thread engaging part 30 of the balance 28 in the vicinity of the forward movement starting point 38 leftward beyond the thread receiving openings 7 of the thread guide plates 5.

While the counter 60 is set to eight in the aforementioned embodiment, the present invention is not restricted to this but a similar effect can be attained by setting the counter 60 to another value.

While the operation of the needle thread 1 is converted to rotation so that the thread breakage detector 62 detects this rotation with the photoelectric switch 49 thereby detecting breakage of the needle thread 1 in the aforementioned embodiment, the present invention is not restricted to this but breakage of the needle thread 1 may alternatively be detected by another method.

In the aforementioned embodiment, the motor 58 may be stopped when the count of the counter 60 reaches a prescribed number (at least 20, for example) within a constant time (10 msec., for example). In this case, the motor 58 can be stopped also when the needle thread 1 is abruptly delivered from the spool beyond necessity due to twining around an internal driving part of the balance 28 or the like.

What is claimed is:

1. A sewing machine comprising:

a thread guide plate having a thread receiving opening;

a balance having a thread engaging part and reciprocating through said thread guide plate so that said thread engaging part captures and pulls a needle thread when forwardly moving from left to right; and a motor for driving said balance, wherein said motor is so stopped as to locate said thread engaging part of said balance in the vicinity of a forward movement starting point leftward beyond said thread receiving opening of said thread guide plate.

2. The sewing machine according to claim 1, further comprising:

an upper shaft set between said motor and said balance so that said balance reciprocates in association with rotation thereof, and an upper shaft rotation detection part detecting rotation of said upper shaft, wherein said motor is stopped on the basis of a result of detection by said upper shaft rotation detection part.

3. The sewing machine according to claim 2, wherein said upper shaft rotation detection part includes:

a first detected element provided on said upper shaft, and a first photoelectric switch detecting said first detected element.

4. The sewing machine according to claim 1, further comprising a thread breakage detection part detecting breakage of said needle thread, wherein said motor is stopped in response to a signal from said thread breakage detection part.

5. The sewing machine according to claim 4, wherein said thread breakage detection part includes:

a rotary part rotating following movement of said needle thread, and a rotation detection part detecting rotation of said rotary part.

6. The sewing machine according to claim 5, wherein said rotary part includes an upper rotator and a lower rotator, said sewing machine further comprises a second detected element provided on a peripheral edge portion of either said upper rotator or said lower rotator, and said rotation detection part includes a second photoelectric switch detecting said second detected element.

7. The sewing machine according to claim 4, further comprising:

an upper shaft set between said motor and said balance so that said balance reciprocates in association with rotation thereof, and an upper shaft rotation detection part for detecting rotation of said upper shaft, for determining breakage of said needle thread and stopping said motor when said rotation detection part of said thread breakage detection part detects no rotation of said rotary part while said upper shaft rotates by a prescribed number of revolutions.

8. The sewing machine according to claim 7, wherein said prescribed number of revolutions is previously set, and said sewing machine further comprises a counter counting up the number of revolutions of said upper shaft and responsively outputting a signal for stopping said motor when the number of revolutions of said upper shaft reaches said prescribed number of revolutions.

9. The sewing machine according to claim 8, wherein said prescribed number of revolutions is eight.

10. The sewing machine according to claim 8, wherein said counter is reset when said rotation detection part of said thread breakage detection part detects rotation of said rotary part.

11. The sewing machine according to claim 8, wherein said counter is reset when said motor is stopped.

* * * * *